United States Patent [19]

Asai et al.

[11] 4,345,179

[45] Aug. 17, 1982

[54] RESISTOR GLASS SEAL SPARK PLUG

[75] Inventors: Tadamichi Asai; Kousuke Nakamura, both of Hitachi, Japan

[73] Assignee: Hitachi, Ltd., Tokyo, Japan

[21] Appl. No.: 167,450

[22] Filed: Jul. 10, 1980

[30] Foreign Application Priority Data

Jul. 13, 1979 [JP] Japan ..... 54-88286

[51] Int. Cl.[3] ..... H01T 13/20

[52] U.S. Cl. ..... 313/136; 313/145; 315/58

[58] Field of Search ..... 313/137, 136, 144, 145; 315/58

[56] References Cited

U.S. PATENT DOCUMENTS

| | | | |
|---|---|---|---|
| 2,248,415 | 7/1941 | Schwartzwalder et al. | 313/136 X |
| 2,459,282 | 1/1949 | McDougal et al. | 313/136 X |
| 3,452,235 | 6/1969 | Hallauer et al. | 313/145 X |
| 3,538,021 | 11/1970 | Achey | 313/145 X |
| 3,567,658 | 3/1971 | Webb et al. | 313/136 X |
| 3,577,355 | 5/1971 | Blum | 313/145 X |
| 4,173,731 | 11/1979 | Takagi et al. | 315/58 |

*Primary Examiner*—Palmer C. Demeo

*Attorney, Agent, or Firm*—Craig and Antonelli

[57] ABSTRACT

A resistor spark plug having, between a terminal screw and a center electrode, electrical conductive glass seals and a resistor glass seal therebetween, said electrical conductive glass seals containing carbon, one or more metals and glass and said resistor glass seal containing carbon, silicon carbide, glass, boron carbide or titanium carbide, and if desired a filler, has a small voltage coefficient of resistance and stable properties and is effective for reducing noise from an ignition system.

6 Claims, 2 Drawing Figures

RESISTOR GLASS SEAL SPARK PLUG

BACKGROUND OF THE INVENTION

This invention relates to resistor spark plugs, more particularly to resistor glass seal spark plugs having a resistor between the lower end of the terminal screw (hereinafter referred to as "screw head") and the center electrode, said resistor comprising electrical conductive glass seals and a resistor glass seal placed therebetween, and said resistor spark plugs being effective for suppressing noise signals generated at the time of spark discharge.

Noise signals produced from automobiles jamming communication waves are mainly produced from spark plugs. In order to reduce such noise signals, it has been known that spark plugs having a built-in resistor are effective as disclosed in U.S. Pat. Nos. 3,567,658 and 3,577,355. In order to attain such an object, there have been known resistor glass seal plugs produced by forming a part of the center electrode of the spark plug by using a mixture of glass and electrical conductive powders so as to have a resistor built-in and by forming airtight sealing between the center electrode and the insulator centerbore. The composition of the electrical conductive glass seals at the side of the screw head and at the side of the center electrode of conventional resistor glass seal spark plugs is almost composed of an electrical conductive metal powders such as copper powder and borosilicate glass and the composition of the resistor glass seal sandwiched between the electrical conductive glass seals mentioned above is in general composed of carbon, silicon carbide, glass and a filler. But these conventional resistor glass seal spark plugs have disadvantages in that they have larger voltage coefficient of resistance (VCR) and are inferior in the amount of noise reduction. Causes for making the VCR larger have been studied and found to be that when airtight sealing of the center electrode is conducted by heating a glass seal material at high temperatures and hot pressing it, a high resistant layer can easily be formed at the contacting portion between the electrical conductive glass seal layer at the side of the screw head and the resistor glass seal layer due to the flow of the glass seal material and said high resistant layer has a larger shared voltage when a high voltage is applied thereto, and that since the electrical conductive glass seal at the side of the screw head intrudes into the resistor glass seal layer, the length of which is substantially shortened due to contiguity of the electric conductive glass seal at the side of the screw head to that at the side of the center electrode, and field strength per unit length applied to the resistor becomes larger. Further it has been found that when the amount of silicon carbide to be added to the resistor glass seal layer becomes larger, VCR becomes larger.

SUMMARY OF THE INVENTION

It is an object of this invention to provide a resistor glass seal spark plug having a small voltage coefficient of resistance (VCR) and stable properties. Another object of this invention is to provide a resistor glass seal spark plug which hardly produces a high resistant layer at the contacting portions between the electrical conductive glass seals and the resistor glass seal in the course of the production of spark plugs.

One of the features of this invention is to add finely powdered carbon having poor wettability to glass compared with a metal powder and having good electroconductivity to at least the electric conductive glass seal material used at the side of the screw head having a metal powder and glass.

Another feature of this invention is to add a special amount of silicon carbide to the resistor glass seal material.

DETAILED DESCRIPTION OF THE INVENTION

Figure 1:
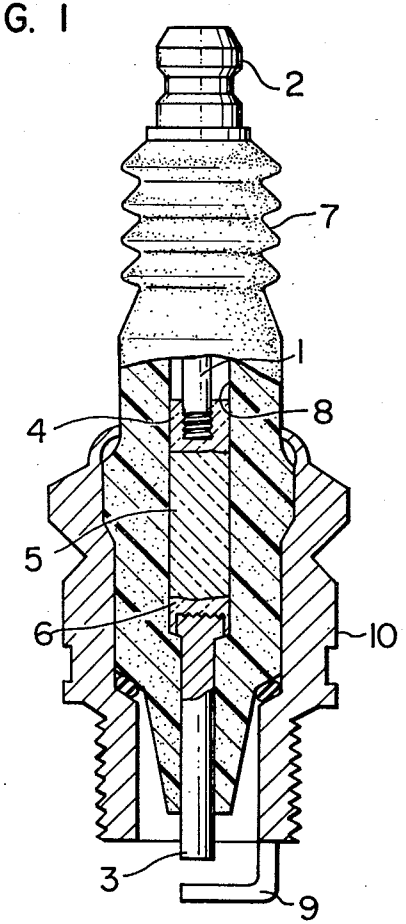
FIG. 1 is a partial sectional view of a conventional resistor glass seal spark plug.

A conventional resistor glass seal spark plug is explained referring to FIG. 1.

At the upper end of the screw head 1, there is formed a terminal 2 which is connected with the outside electrically and at the lower end of the insulator, there is formed a center electrode 3. Between the screw head 1 and the center electrode 3, there are an electric conductive glass seal 4 at the side of the screw head, a resistor glass seal 5 and an electrical conductive glass seal 6 at the side of the center electrode. The screw head 1 is covered by alumina insulator 7, at the center of which is formed insulator centerbore 8, wherein the center electrode 3, individual seals 6, 5 and 4, and the screw head 1 are positioned. The alumina insulator 7 is placed in an outer shell 10 having a ground electrode 9 at the lower end thereof. The center electrode 3 and the ground electrode 9 form a pair of discharge electrodes.

Such a resistor glass seal spark plug is generally produced by positioning the center electrode 3 in the centerbore 8 of the alumina insulator 7, filling thereon the electric conductive glass seal 6 at the side of the center electrode, the resistor glass seal 5, and the electric conductive glass seal 4 at the side of the screw head, placing the screw head 1 on the glass seal 4, heating the whole assembly in a furnace and forcing the screw head 1 down into the centerbore by applying pressure and at the same time glass sealing the inner portion of the centerbore 8. The resulting structure thus formed containing the center electrode is placed in the outer shell 10 having the ground electrode 9 to give the desired product.

The compositions of both the electric conductive glass seal 4 at the side of the screw head and that 6 at the side of the center electrode of the conventional resistor glass seal spark plugs contain, in most cases, a metal and glass and the composition of the resistor glass seal 5 contains, in most cases, carbon, silicon carbide, glass and a filler.

An example of producing a conventional resistor glass seal spark plug is given below.

An electrical conductive glass seal material is produced by adding 0.3 part by weight of polyvinyl alcohol (PVA) to a mixture of 50 parts by weight of borosilicate glass powders and 50 parts by weight of finely powdered copper. A resistor glass seal material is produced by adding 0.3 part by weight of PVA to a mixture of 70.5 parts by weight of borosilicate glass powders, 4.5 parts by weight of carbon powders, 20 parts by weight of silicon carbide powders and 5 parts by weight of alumina powders. After placing a center electrode 3 in the centerbore 8 of an alumina insulator for spark plugs, 0.1 g of the electric conductive glass seal material is filled in the centerbore, 0.35 g of the resistor glass seal material is filled thereon, 0.25 g of the electrical conductive glass seal material is filled thereon, and finally a screw head 1 is placed thereon. The whole assembly is placed in a furnace and heated to 850° C. and pressure is applied to the screw head so as to force it down into the centerbore. The resulting structure is allowed to stand for cooling, and placed in an outer shell 10 to give a resistor glass seal spark plug.

Figure 2:
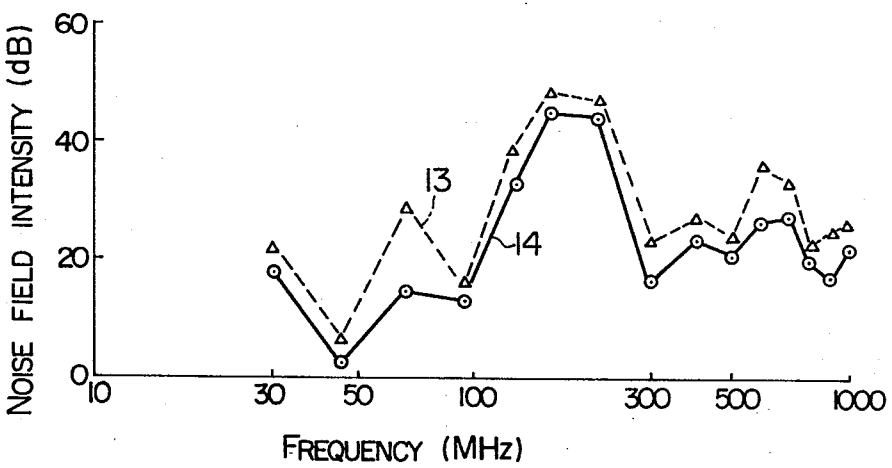
FIG. 2 is a graph showing characteristics of noise field intensity.

The thus produced resistor glass seal spark plugs (130 in the number) have initial resistance values (Ra) of 2.5 to 7.2 kΩ, VCR of −80 ppm/V when 10 kVp is applied, and noise field intensity as shown in FIG. 2 in the broken line 13. As mentioned above, the conventional resistor glass seal spark plugs have defects in that the voltage coefficient of resistance (VCR) is large and the amount of noise reduction is poor.

The present inventors have studied causes for making the VCR larger and found that the VCR becomes larger in the cases when a high resistant layer, which can easily be formed at the contacting portion between the electrical conductive glass seal 4 at the side of the screw head and the resistor glass seal 5 due to the flow of the glass seal material at the time of heating the glass seal material at a high temperature and hot pressing it so as to conduct airtight sealing of the center electrode 3, shows a larger shared voltage in the case of applying a high voltage thereto, when the length of the resistor glass seal becomes substantially shorter due to contiguity of the electric conductive glass seal 4 at the side of the screw head and that 6 at the side of the center electrode caused by the intrusion of the conductive glass seal 4 into the resistor glass seal 5 and field strength per unit length applied to the resistor becomes larger, and when the amount of silicon carbide to be added is large.

In order to remove such defects, various experiments have been conducted. As a result, the following facts have been found; that is, when fine powders of carbon which is poor in wettability to glass compared with a metal powder and has good electroconductivity is added to at least the electric conductive glass seal material at the side of the screw head, no high resistant layer is produced at the contacting portion between the electrical conductive glass seal 4 at the side of the screw head and the resistor glass seal 5, and no intrusion of the electrical conductive glass seal 4 at the side of the screw head into the resistor glass seal 5 takes place, which results in improving the form of the resistor glass seal 5, that is, the length of the resistor glass seal 5 becomes substantially longer; and when the proportion of carbide in the resistor glass seal material is reduced, the VCR can be improved.

This invention is illustrated by way of the following Examples.

EXAMPLES

Each 40 resistor glass seal spark plugs for each sample (Sample Nos. 1 to 6) were produced by using the conventional process mentioned above and using electrical conductive glass seal materials as listed in Table 1 for forming the electrical conductive glass seals 4 and 6 shown in FIG. 1 and the conventional resistor glass seal material mentioned above. Average VCR of these resistor glass seal spark plugs is as shown in Table 1.

VCR was obtained from the following equation:

$$VCR = \frac{R_H - R_L}{R_L} \times \frac{10^6}{V_H - V_L} \text{ (ppm/V)}$$

wherein $R_L$ is a resistance at a low voltage $V_L$ (e.g. 4.5 V) and $R_H$ is a resistance at a high voltage $V_H$ (e.g. 10 kV).

As is clear from Table 1, when carbon is added to the electrical conductive glass seal material, VCR is considerably lowered compared with the case of using no carbon (−80 ppm/V) as mentioned previously.

TABLE 1

| Sample No. | Composition of electrical conductive glass seal material (parts by weight) | | | | | VCR (ppm/V) |
|---|---|---|---|---|---|---|
| | Carbon | Copper | Glass | Iron | Brass | |
| 1 | 5 | 45 | 50 | — | — | −60 |
| 2 | 10 | 40 | 50 | — | — | −51 |
| 3 | 20 | 20 | 60 | — | — | −53 |
| 4 | 15 | 25 | 60 | — | — | −50 |
| 5 | 10 | — | 50 | 40 | — | −53 |
| 6 | 10 | — | 50 | — | 40 | −52 |

Each 40 resistor glass seal spark plugs for each sample (Sample Nos. 7 to 13) were produced by using the conventional process and using electrical conductive glass seal materials as listed in Table 2 for forming the electrical conductive glass seals 4 and 6 and a resistor glass seal material prepared by adding 0.3 part by weight of PVA to a mixture of 90.7 parts by weight of borosilicate glass powders, 4.3 parts by weight of carbon powders, and 5 parts by weight of silicon carbide powders. Average VCR of these resistor glass seal spark plugs is as shown in Table 2.

TABLE 2

| Sample No. | Composition of electrical conductive glass seal material (parts by weight) | | | | | VCR (ppm/V) |
|---|---|---|---|---|---|---|
| | Carbon | Copper | Glass | Iron | Brass | |
| 7 | 5 | 45 | 50 | — | — | −40 |
| 8 | 10 | 40 | 50 | — | — | −33 |
| 9 | 20 | 20 | 60 | — | — | −35 |
| 10 | 15 | 25 | 60 | — | — | −34 |
| 11 | — | 50 | 50 | — | — | −66 |
| 12 | 10 | — | 50 | 40 | — | −31 |
| 13 | 10 | — | 50 | — | 40 | −32 |

Each 40 resistor glass seal spark plugs for each sample (Sample Nos. 14 to 21) were produced by using the conventional process and using electrical conductive glass seal materials as listed in Table 3 for forming the electrical conductive glass seals 4 and 6 and a resistor glass seal material prepared by adding 0.3 part by weight of PVA to a mixture of 85.6 parts by weight of borosilicate glass powders, 4.4 parts by weight of carbon powders and 10 parts by weight of silicon carbide powders. Average VCR of these resistor glass seal spark plugs is as shown in Table 3.

TABLE 3

| Sample No. | Composition of electrical conductive glass seal material (parts by weight) | | | | | | VCR (ppm/V) |
|---|---|---|---|---|---|---|---|
| | Carbon | Copper | Glass | Brass | Iron | Nickel | |
| 14 | 5 | 45 | 50 | — | — | — | −46 |
| 15 | 10 | 40 | 50 | — | — | — | −41 |
| 16 | 15 | 25 | 60 | — | — | — | −43 |
| 17 | 20 | 20 | 60 | — | — | — | −47 |
| 18 | — | 50 | 50 | — | — | — | −74 |
| 19 | 10 | — | 50 | 40 | — | — | −41 |
| 20 | 10 | — | 50 | — | 40 | — | −42 |

TABLE 3-continued

| Sample No. | Composition of electrical conductive glass seal material (parts by weight) Carbon | Copper | Glass | Brass | Iron | Nickel | VCR (ppm/V) |
|---|---|---|---|---|---|---|---|
| 21 | 10 | — | 50 | — | — | 40 | −41 |

Each 40 resistor glass seal spark plugs for each sample (Sample Nos. 22 to 29) were produced by using the conventional process and using electrical conductive glass seal materials as listed in Table 4 for forming the electrical conductive glass seals 4 and 6 (hereinafter these being not described but not omitted) and a resistor glass seal material prepared by adding 0.3 part by weight of PVA to a mixture of 80.5 parts by weight of borosilicate glass powders, 4.5 parts by weight of carbon powders, 5 parts by weight of silicon carbide powders, 5 parts by weight of titanium carbide powders and 5 parts by weight of boron carbide powders. Average VCR of these resistor glass seal spark plugs is shown in Table 4.

TABLE 4

| Sample No. | Composition of electrical conductive glass seal material (parts by weight) Carbon | Copper | Glass | Brass | Iron | Nickel | VCR (ppm/V) |
|---|---|---|---|---|---|---|---|
| 22 | 5 | 45 | 50 | — | — | — | −51 |
| 23 | 10 | 40 | 50 | — | — | — | −44 |
| 24 | 15 | 25 | 60 | — | — | — | −53 |
| 25 | 20 | 20 | 60 | — | — | — | −55 |
| 26 | — | 50 | 50 | — | — | — | −83 |
| 27 | 10 | — | 50 | 40 | — | — | −46 |
| 28 | 10 | — | 50 | — | 40 | — | −46 |
| 29 | 10 | — | 50 | — | — | 40 | −47 |

Each 40 resistor glass seal spark plugs for each sample (Sample Nos. 30 to 38) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 5. Average VCR of these resistor glass seal spark plugs is as shown in Table 5.

TABLE 5

| Sample No. | Composition of resister glass seal material (parts by weight) Carbon | Silicon carbide | Titanium carbide | Boron carbide | Glass | Alumina | Silica | Zirconia | VCR (ppm/V) |
|---|---|---|---|---|---|---|---|---|---|
| 30 | 5.0 | 10 | — | 5 | 80 | 10 | — | — | −47 |
| 31 | 5.3 | 10 | 5 | — | 79.7 | 20 | — | — | −48 |
| 32 | 5.6 | 5 | 5 | 5 | 79.4 | 30 | — | — | −50 |
| 33 | 5.4 | 10 | 5 | — | 79.6 | — | 20 | — | −44 |
| 34 | 5.2 | 10 | 5 | — | 79.8 | — | 10 | — | −43 |
| 35 | 4.9 | 3 | 5 | 2 | 85.1 | — | 5 | — | −48 |
| 36 | 5.7 | 3 | 3 | 15 | 73.3 | — | 5 | — | −67 |
| 37 | 5.1 | 6 | 5 | 4 | 79.9 | — | — | 10 | −51 |
| 38 | 5.3 | 6 | 5 | 4 | 79.7 | — | — | 20 | −52 |

As shown in Tables 1 to 5, when carbon is added to the electrical conductive glass seal materials, VCR becomes lower than conventional ones.

Each 40 resistor glass seal spark plugs for each sample (Sample Nos. 39 to 43) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 6.

Table 6 shows changes (in percentage) of resistance values after the spark durability test carried out for 250 hours continuously wherein spark is discharged by applying a high voltage (about 15 kV) between a center electrode and a ground electrode of these resistor glass seal spark plugs.

As shown in Table 6, when a carbide is contained in an amount of 3 parts by weight as in Sample No. 43 (silicon carbide being essential) in the resistor glass seal material, percentage of the change becomes 125%, which is a limit value for practical use. When the carbide is less than 3 parts by weight, the resistance values after the spark durability test are twice or more as large as the initial values; this is not preferable.

TABLE 6

| Sample No. | Composition of resistor glass seal material (parts by weight) Carbide | Glass | Carbon | Zirconia | Change of resistance value after spark durability test (%) |
|---|---|---|---|---|---|
| 39 | 1.5 | 90.5 | 3.0 | 5 | 480 |
| 40 | 2.0 | 89.9 | 3.1 | 5 | 340 |
| 41 | 2.5 | 89.3 | 3.2 | 5 | 260 |
| 42 | 2.7 | 89.1 | 3.2 | 5 | 210 |
| 43 | 3 | 88.6 | 3.4 | 5 | 125 |

On the other hand, when the proportion of the carbide in the resistor glass seal material is too much as shown in Table 7, VCR becomes unfavorably larger and noise field intensity also becomes unfavorably larger.

Each 40 resistor glass seal spark plugs for each sample (Sample Nos. 44 to 47) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 7. Average VCR of these resistor glass seal spark plugs is shown in Table 7.

TABLE 7

| Sample No. | Composition of resistor glass seal material (parts by weight) Carbide | Glass | Carbon | Alumina | VCR (ppm/V) |
|---|---|---|---|---|---|
| 44 | 20 | 67 | 8 | 5 | −80 |
| 45 | 25 | 61.7 | 8.3 | 5 | −82 |
| 46 | 30 | 56.5 | 8.5 | 5 | −85 |
| 47 | 35 | 51 | 9.0 | 5 | −89 |

As to the amount of carbon in the resistor glass seal material, it is preferable to use 3 to 10 parts by weight of carbon per 100 parts by weight of the resistor glass seal material. This is shown in Tables 8 and 9.

Each 40 resistor glass seal spark plugs for each sample (Sample Nos. 48 to 51) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 8. Average resistance values of these resistor glass seal spark plugs are shown in Table 8. As shown in Table 8, the resistance value of Sample No. 51 containing carbon in an amount of 3 parts by weight is good but those of other samples are not preferable because of too high resistance values.

On the other hand, each 40 resistor glass seal spark plugs for each sample (Sample Nos. 52 to 55) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 9. Average resistance values of these resistor glass seal spark plugs are shown in Table 9. As shown in Table 9, the resistance value of Sample No. 52 is proper but those of other samples are not preferable because of too low resistance values.

TABLE 8

| Sample No. | Composition of resistor glass seal material (parts by weight) | | | | Resistance value (kΩ) |
|---|---|---|---|---|---|
| | Carbon | Silicon carbide | Boron carbide | Glass | |
| 48 | 2.0 | 10 | 5 | 83 | 210 |
| 49 | 2.5 | 5 | 10 | 82.5 | 74 |
| 50 | 2.7 | 5 | 5 | 87.3 | 136 |
| 51 | 3.0 | 5 | 5 | 87.0 | 21 |

TABLE 9

| Sample No. | Composition of resistor glass seal material (parts by weight) | | | | Resistance value (kΩ) |
|---|---|---|---|---|---|
| | Carbon | Silicon carbide | Titanium carbide | Glass | |
| 52 | 10 | 10 | 10 | 70 | 1.5 |
| 53 | 11 | 10 | 5 | 74 | 0.9 |
| 54 | 12 | 5 | 10 | 73 | 0.7 |
| 55 | 13 | 8 | 7 | 72 | 0.6 |

Each 40 resistor glass seal spark plugs for each sample (Sample Nos. 56 to 60) were produced by using the conventional process and using an electrical conductive glass seal material of a mixture of 10 parts by weight of carbon powders, 50 parts by weight of copper powders and 40 parts by weight of glass powders and resistor glass seal materials as listed in Table 10. Changes of resistance values after the spark durability test are shown in Table 10. As shown in Table 10, the amount of alumina added as an electrical insulating filler to the resistor glass seal material is preferably 30 parts by weight or less per 100 parts by weight of the resistor glass seal material.

TABLE 10

| Sample No. | Composition of resistor glass seal material (parts by weight) | | | | Change of resistance value after spark durability test (%) |
|---|---|---|---|---|---|
| | Alumina | Carbon | Carbide | Glass | |
| 56 | 25 | 5.0 | 15 | 55 | 125 |
| 57 | 30 | 5.1 | 15 | 49.9 | 130 |
| 58 | 33 | 5.2 | 15 | 46.8 | 140 |
| 59 | 35 | 5.3 | 15 | 44.7 | 180 |
| 60 | 40 | 5.5 | 15 | 39.5 | 260 |

Each 40 resistor glass seal spark plugs for each sample (Sample Nos. 61 to 65) were produced by using the conventional process and using electrical conductive glass seal materials as listed in Table 11 and a resistor glass seal material prepared by adding 0.3 part by weight of PVA to a mixture of 85.7 parts by weight of borosilicate glass powders, 4.3 parts by weight of carbon powders, and 10 parts by weight of silicon carbide powders. Average VCR of these resistor glass seal spark plugs is shown in Table 11. As shown in Table 11, VCR of Sample Nos. 61 and 62 containing carbon in amounts of 2 parts by weight or more is good and as low as −70 ppm/V or less.

TABLE 11

| Sample No. | Composition of electrical conductive glass seal material (parts by weight) | | | VCR (ppm/V) |
|---|---|---|---|---|
| | Carbon | Copper | Glass | |
| 61 | 2.5 | 50 | 47.5 | −63 |
| 62 | 2.0 | 50 | 48 | −67 |
| 63 | 1.7 | 50 | 48.3 | −71 |
| 64 | 1.5 | 50 | 48.5 | −73 |
| 65 | 1.0 | 50 | 49 | −74 |

Each 40 resistor glass seal spark plugs for each sample (Sample Nos. 66 to 69) were produced by using the conventional process and using electrical conductive glass seal materials as listed in Table 12 and a resistor glass seal material prepared by adding 0.3 part by weight of PVA to a mixture of 85.6 parts by weight of borosilicate glass powders, 4.4 parts by weight of carbon powders and 10 parts by weight of silicon carbide powders. Changes of resistance values after the spark durability test are shown in Table 12. As shown in Table 12, the change of Sample No. 66 containing carbon in an amount of 20 parts by weight or less is relatively small (128%) but those of other samples are undesirably large.

TABLE 12

| Sample No. | Composition of electrical conductive glass seal material (parts by weight) | | | Change of resistance value after spark durability test (%) |
|---|---|---|---|---|
| | Carbon | Copper | Glass | |
| 66 | 20 | 40 | 40 | 128 |
| 67 | 23 | 40 | 37 | 140 |
| 68 | 26 | 40 | 34 | 170 |
| 69 | 30 | 40 | 30 | 230 |

As shown in Tables 11 and 12, when the amount of carbon in the electrical conductive glass seal material is less than 2 parts by weight per 100 parts by weight of the material, the effect of lowering VCR is very little, while when the amount of carbon is more than 20 parts by weight per 100 parts by weight of the material, changes of resistance values after the spark durability test become undesirably large. Therefore, the amount of carbon in the electrical conductive glass seal material is preferably in the range of 2 to 20 parts by weight per 100 parts by weight of the material. Particle size of carbon is preferably 10 μm or less, more preferably 1 μm or less.

As to metal powders used in the electrical conductive glass seal material, copper powder is used in the above-mentioned examples, but other metal powders such as iron, brass and nickel powders can also preferably be used. These metal powders can be used alone or as a mixture thereof. Particle size of the metal powders is preferably that passing a 200 mesh sieve, and more preferably 10 μm or less. In addition, silver, gold, platinum and the like powders can also be used as the metal powders in the electrical conductive glass seal material but they are expensive. It is not preferable to use tungsten, molybdenum and palladium powders because of deviating the resistance values considerably.

The amount of glass in the electrical conductive glass seal material is preferably in the range of 35 to 65 parts by weight per 100 parts by weight of the material. If the amount of glass is less than 35 parts by weight, the screw head 1 as shown in FIG. 1 can easily come off, while if the amount of glass is more than 65 parts by weight, the resistance values are undesirably deviated.

The amount of glass in the resistor glass seal material is preferably in the range of 45 to 94 parts by weight per 100 parts by weight of the material. If the amount of glass is less than 45 parts by weight, airtightness of the resistor glass seal spark plugs becomes worse, while if the amount of glass is more than 94 parts by weight, the resistance values are undesirably deviated.

In summary, a preferable composition of the electrical conductive glass seal material is 2 to 20 parts by weight of carbon powder, 25 to 60 parts by weight of one or more metal powders and 35 to 65 parts by weight of glass powder, a total being 100 parts by weight.

Further, a preferable composition of the resistor glass seal material is 3 to 10 parts by weight of carbon powder, 1.5 to 10 parts by weight of silicon carbide powder, 45 to 94 parts by weight of glass powder and 1.5 to 10 parts by weight of at least one carbide selected from silicon carbide, boron carbide and titanium carbide, a total being 100 parts by weight. The resistor glass seal material may contain 30 parts by weight or less of at least one electrical insulating filler such as alumina, silica, zirconia, and the like per 100 parts by weight of the resistor glass seal material.

As mentioned above, the resistor glass seal spark plugs of this invention have low VCR and, as a result, have low noise field intensity as shown in full line 14 of FIG. 2 compared with conventional resistor glass seal spark plugs. Since the special electrical conductive glass seal material and the special resistor glass seal material are used in this invention for producing resistor glass seal spark plugs, the resulting spark plugs have low voltage coefficient of resistance (VCR) and stable properties.

What is claimed is:

1. In a resistor glass seal spark plug having between a terminal screw and a center electrode an electrical conductive glass seal at the side of the lower end of the terminal screw, a resistor glass seal and an electrical conductive glass seal at the side of the center electrode, the improvement wherein the electrical conductive glass seal at least at the side of the lower end of the terminal screw comprises carbon, one or more metals and glass.

2. A resistor glass seal spark plug according to claim 1, wherein the electrical conductive glass seal comprises 2 to 20 parts by weight of carbon, 25 to 60 parts by weight of one or more metals, and 35 to 65 parts by weight of glass, a total being 100 parts by weight.

3. A resistor glass seal spark plug according to claim 2, wherein the metal is copper, iron, brass, nickel, silver, gold or platinum.

4. A resistor glass seal spark plug according to claim 1, wherein the electrical conductive glass seal comprises 2 to 20 parts by weight of carbon, 25 to 60 parts by weight of one or more metals and 35 to 65 parts by weight of glass, a total being 100 parts by weight, and the resistor glass seal comprises 3 to 10 parts by weight of carbon, 1.5 to 10 parts by weight of silicon carbide, 45 to 94 parts by weight of glass and 1.5 to 10 parts by weight of at least one carbide selected from silicon carbide, boron carbide and titanium carbide, a total being 100 parts by weight.

5. A resistor glass seal spark plug according to claim 4, wherein the resistor glass seal comprising 3 to 10 parts by weight of carbon, 1.5 to 10 parts by weight of silicon carbide, 45 to 94 parts by weight of glass and 1.5 to 10 parts by weight of at least one carbide selected from silicon carbide, boron carbide and titanium carbide further contains 30 parts by weight or less of at least one electrical insulating filler per 100 parts by weight of the resistor glass seal.

6. A resistor glass seal spark plug according to claim 5, wherein the electrical insulating filler is alumina, silica or zirconia.

* * * * *